US005851148A

United States Patent [19]

Brune et al.

[11] Patent Number: 5,851,148

[45] Date of Patent: Dec. 22, 1998

[54] GAME WITH BONUS DISPLAY

[75] Inventors: Chris T. Brune; Robert A. Luciano, Jr., both of Reno, Nev.

[73] Assignee: International Game Technology, Reno, Nev.

[21] Appl. No.: 723,136

[22] Filed: Sep. 30, 1996

[51] Int. Cl.[6] ..... A63F 9/00

[52] U.S. Cl. ..... 463/25

[58] Field of Search ..... 463/25, 26, 27, 463/28, 30, 31, 33, 34, 13, 12

[56] References Cited

FOREIGN PATENT DOCUMENTS

| | | | |
|---|---|---|---|
| 48825/85 | 5/1986 | Australia | G07F 17/34 |
| 2 182 186 | 5/1987 | United Kingdom | G07F 17/34 |

OTHER PUBLICATIONS

"Old ideas make new ideas", *Loose Change,* Sep. 1996, pp. 22–24.

*Primary Examiner*—George Manuel
*Attorney, Agent, or Firm*—Sheridan Ross P.C.

[57] ABSTRACT

A game such as a video poker or other card game is provided with a feature providing an incentive for multiple hand or multiple game play. In one embodiment, some or all of the cards of each hand, such as only necessary winning cards, are used to increment the value in corresponding memory locations. When a given memory location reaches a predetermined value, an indicator corresponding to that memory location and the corresponding card is illuminated. When all indicators are illuminated, the player wins a bonus which may be based on the amount wagered.

28 Claims, 5 Drawing Sheets

COMPUTER
MEMORY
134
PAY TABLE
112
BONUS METER
136
2-SPADES
3-SPADES
4-SPADES
.
.
.
KING-CLUBS
ACE-CLUBS
138
113b
126
128
113a
CPU
NETWORK CARD
CENTRAL COMPUTER
124
SCOREBOARD DISPLAY
TOUCHSCREEN INPUT
COIN, CURRENCY OR CARD ACCEPTOR
122
SCREEN
116
BUTTONS
120
MODEM
114
118
130

GAME WITH BONUS DISPLAY

The present invention is related to a game such as a simulated card game and in particular to a card game simulation which provides for electronic display including display of progress towards a multi-game goal.

BACKGROUND INFORMATION

A number of electronic devices are configured to simulate play of traditional games such as a card game, e.g., poker or blackjack. Typically, in such devices, a screen or other display device provides an image of simulated cards dealt to the player and is provided with buttons or other input devices to permit the player to place wagers, and take similar actions associated with playing a card game. While some previous devices provide reasonable entertainment value by simulating a traditional card game, it is believed there is an opportunity to increase the entertainment potential by providing an incentive to play multiple hands or games. Such a device has the potential not only to increase entertainment value, but, in contexts such as a gaming casino or other contexts in which revenues are generated by game playing, it is believed there is a potential for enhancing the revenue of the casino operator.

Accordingly, there is a need for a method and device for a game such as a simulated card game which provides an effective incentive for multiple hand or multiple game playing. Additionally, there is a need to provide such incentive in a manner which permits it, at least in some contexts, to be retrofitted in current gaming devices or otherwise to provide for implementation at relatively low cost.

SUMMARY OF THE INVENTION

The present invention provides for an incentive for multi-game or multi-hand play by establishing one or more goals, preferably associated with a prize, such that multiple games or hands are required to reach the goals. Preferably the device provides a display or other indication of the player's progress towards the multi-game goal. In one embodiment, a display is provided which has indicators corresponding to some or all of the cards of a standard 52-card deck. For some or all hands, such as when a player has a winning hand, counters are incremented which correspond to some or all of the cards of the winning hand. When a counter corresponding to a given card of the deck reaches a predetermined value, the display corresponding to that card is illuminated, unilluminated or otherwise indicated. When all indicia on the display, or a predetermined part of the display, have been indicated, the player has reached the goal and, preferably, is awarded a prize such as a prize based on wagers placed during play of the game.

DETAILED DESCRIPTION OF THE PREFERRED EMBODIMENTS

Figure 1:
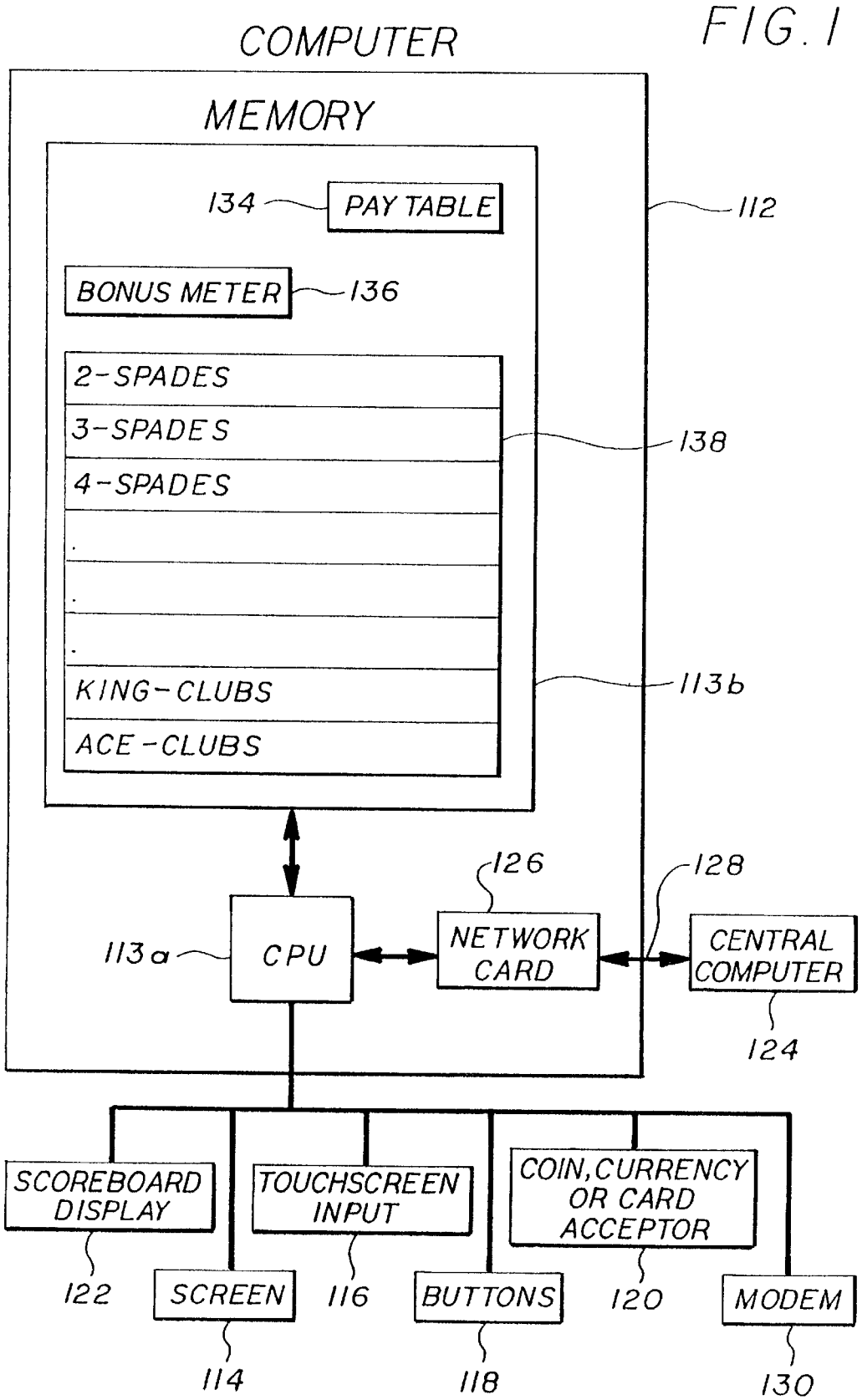
FIG. 1 is a block diagram of a computer-implemented system that may be used in connection with one embodiment of the present invention.

As depicted in FIG. 1, in one embodiment, a gaming device is provided with a microprocessor or other computer

112 having a central processing unit 113*a* and memory 113*b*. The computer may be coupled to a number of peripheral devices such as a display screen 114, possibly having a touch screen input 116, and/or buttons, keys or other user input devices 118. Preferably a coin, currency or card acceptor device 120 permits a player to place wagers. A scoreboard display or other display device 122 provides an indication of progress towards a multi-game goal. In one embodiment, the gaming device computer is coupled to one or more other computers such as a central computer of a casino 124, e.g., via a network card 126 and link 128, modem 130 and the like. To assist in keeping track of the progress towards the goal, in the embodiment of FIG. 1, counters are defined corresponding to various gaming pieces (such as cards, in the case of a simulated card game) involved in the progress or goal analysis. Various items may be used as counters, including hardware counters and memory locations 138 in which the computer may store, increment, decrement or initialize values. In the depicted embodiment, the game is a simulated card game in which the gaming pieces are 52 cards and thus there are 52 memory locations 138, each corresponding to one of the cards.

Figure 3:
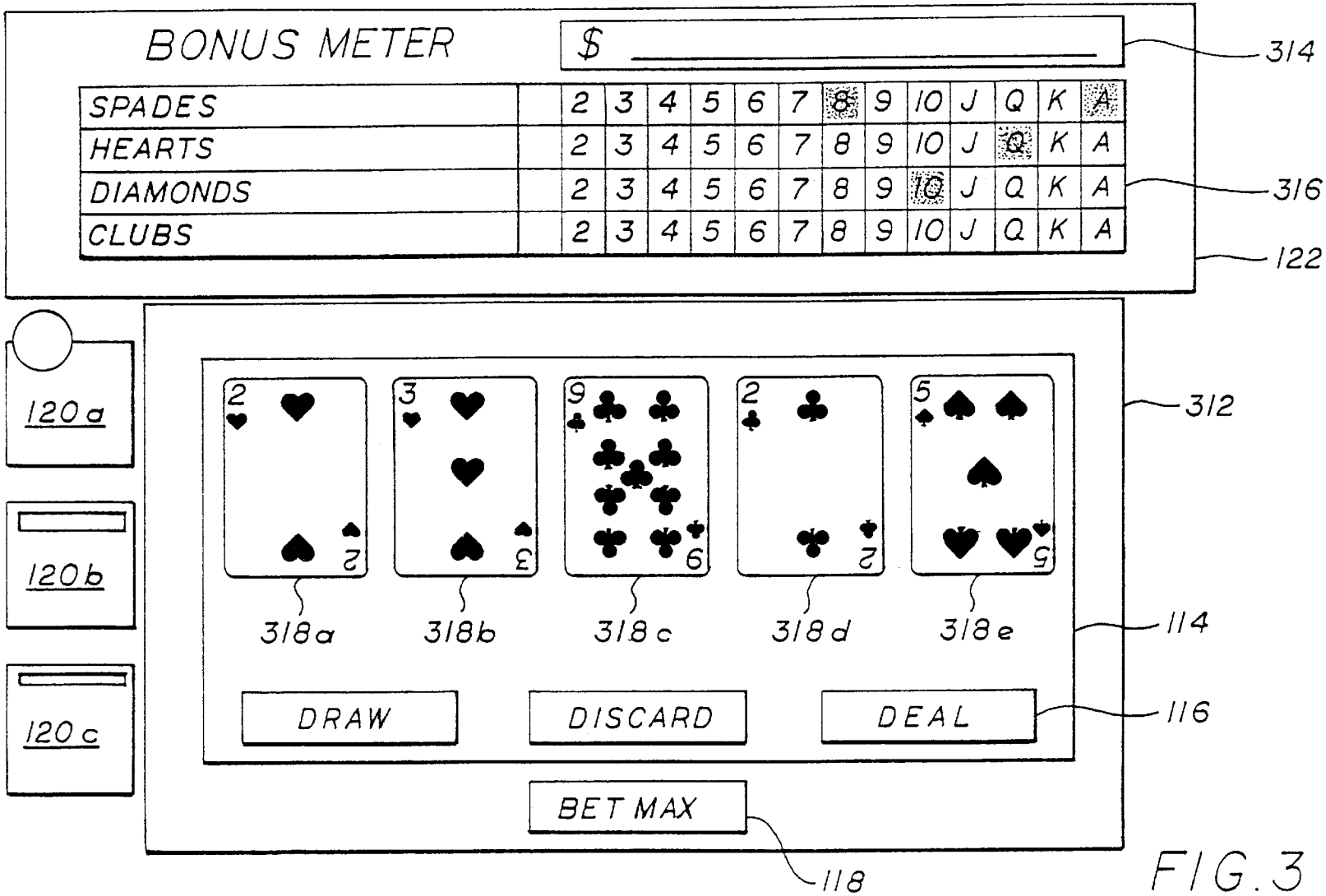
FIG. 3 is a front elevational view of a gaming device according to one embodiment of the present invention.

The microprocessor or other computer 112 is housed in a gaming device which may have a configuration similar to that depicted in FIG. 3. As shown in FIG. 3, the gaming device 312 includes the display screen 114 (such as a cathode ray tube CRT, liquid crystal display LCD, and/or a display based on light emitting diodes LEDs). The display 114 may have touch screen capability defining various touch screen input regions such as "soft buttons" 116 for providing input to the computer 112, as well as one or more user activatable keys or buttons 118. A coin acceptor 120*a*, currency acceptor 120*b*, and/or card acceptor 120*c* (e.g., for accepting a credit card, gaming card, smart card and the like) are also coupled to the device 312. The scoreboard display 122 provides a region 314 indicating the current amount of the bonus prize and a region 316 indicating the player's progress towards the goal, as described more fully below. Although, in the depicted embodiment, the scoreboard 122 is provided separately from the display screen 114, it is possible to use the display screen 114 to display the progress indicator 316 and/or bonus meter 314. The display 122 may include separately illuminatable and controllable indicia-bearing panels, and/or standard computer-controlled display devices such as one or more CRTs, LCDs, LEDs and the like.

Figure 2:
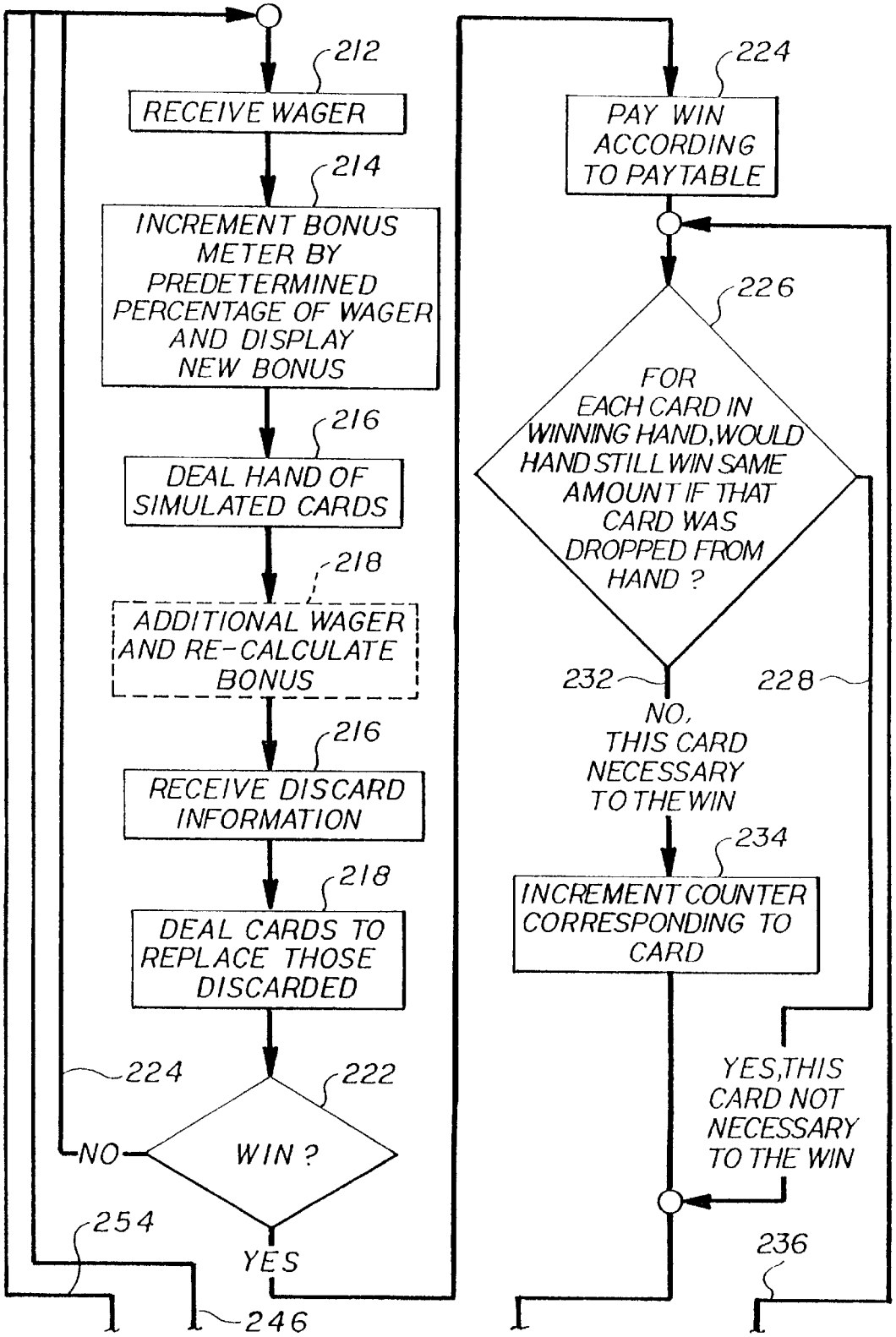
FIG. 2 is a flow chart depicting a method according to one embodiment of the present invention.
Figure 2:
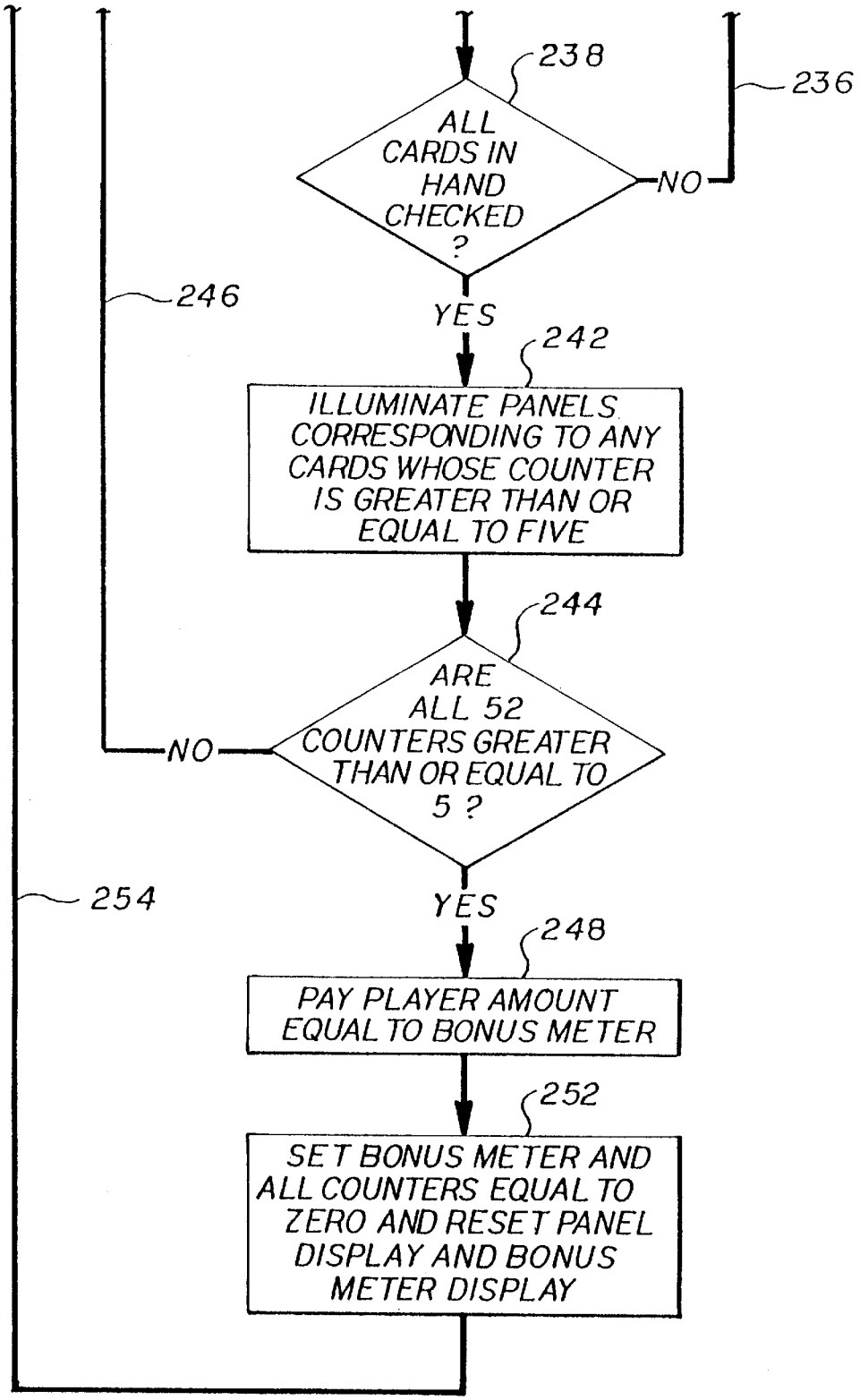

The computer 112 is programmed to implement the multi-game incentive feature, and FIG. 2 depicts one method of such implementation. In the embodiment of FIG. 2, play of a game or hand is initiated when the computer 112 receives an indication that a wager has been received 212, e.g., via coin, currency or card acceptors 120. If desired the system may be configured such that a minimum wager is needed to be eligible to win a multi-game prize. In the depicted embodiment, a bonus or prize that is displayed 314 and awarded upon reaching the goal is for an amount which is related to the amount of wagers placed since the last award of a bonus. For example, in one embodiment, the bonus meter is progressive and will increase at the rate of one credit for each predetermined increment of credits played. In other embodiments, the increase in the bonus meter could be based on other "trigger events" or items, such as the number of games played, the number of non-winning games, the number of winning cards, and the like. In one embodiment, the amount of the predetermined increment is fixed. This amount of predetermined increment may be stored in the memory 113*b*, e.g., along with other game-defining data, in a "pay table" portion 134 of memory. In one example, the bonus meter will increase at the rate of 25 cents for every $5.00 of credits played. Thus, after the wager is received 212, the computer will increment the current amount of the bonus, stored in a bonus meter memory location 136, by a predetermined percentage or portion of the wager 214 and will increment the display 314 which shows the current amount of the bonus.

A hand of simulated cards is dealt (typically by selection based on random numbers generated by the computer 112) and the simulated cards which were dealt are displayed on the display screen 216, as depicted in FIG. 3 by card images 318*a*, 318*b*, 318*c*, 318*d*, 318*e*. The manner in which the game is played will depend upon the particular rules for the game (e.g., whether this is a stud poker game, draw poker game, blackjack game, etc.). In some cases, the user may be permitted to place an additional wager 218 at an intermediate stage of the game, e.g., before discarding cards or before receiving a draw to replace discarded cards 218. In the depicted embodiment, the user uses the touch screen or other input devices to indicate which, if any, cards the user wishes to discard 216, and the computer 112 then determines which cards will replace those that were discarded 218, e.g., using a random number generator. At some point, the hand is finished and the computer can determine whether the player has a winning hand, e.g., by consulting the pay table 134. If the hand is not a winning hand 222, the procedure returns 224 to receive the next wager 212.

If there has been a win 222, the device 312 credits the player's account, smart card or otherwise pays the win amount 224 according to the pay table 134. In the depicted embodiment, cards result in progress towards the goal only if they are in a winning hand and they are cards that were necessary for making that hand a winning hand. To determine if a card is a necessary card, it is possible to perform a test which determines, for each card in the winning hand, whether the hand would still win the same amount (according to the pay table 134) if that card had been dropped from the hand 226. Thus, in certain forms of poker, a winning hand which is a royal flush, straight flush, full house, flush or straight requires the presence of all five cards and thus all five cards would be "necessary winning" cards. If a winning hand is four of a kind or two pair, only four of the five cards are required in the sense that there is always one card which could be dropped from the hand of five cards and still result in four of a kind or two pair. Similarly, if the winning hand is three of a kind, three cards are necessary winning cards, and if a winning hand is one pair, two cards are necessary winning cards. The determination of whether cards are winning cards 226 can be performed either by performing a logical test on each card in a winning hand as depicted in FIG. 2, or by consulting a look-up table configured for this purpose. In either case, if it is determined that a card in the winning hand could be dropped, without affecting the outcome, that card is not a necessary winning card 228, and the memory location 138 corresponding to that card is not incremented.

If the card cannot be dropped from the hand without affecting the result, the card is necessary to the winning hand 232 and thus the computer 112 increments the value stored in the memory location 138 corresponding to that card 234. The procedure loops through the step 236 until all five cards in the hand have been checked 238.

At this point, the memory locations 138 have been updated to reflect the progress towards the goal and the computer 112 then makes any necessary changes to the illumination or other highlighting or indication in the scoreboard panel 122 to reflect the progress towards the goal. In one embodiment, a memory location 138 must reach a predetermined value, such as 5, before the corresponding indicator in the scoreboard 316 is highlighted or illuminated. Thus, in this embodiment, in order to win the bonus 314, the user must play sufficient games to increment the memory locations 138 corresponding to each of the 52 cards, at least five times.

After illuminating the panels or otherwise updating the scoreboard display as appropriate 242, the computer 112 determines whether all 52 memory locations 138 have values greater than or equal to five 244 (i.e., whether all panels on the display 316 have been illuminated or highlighted). If not, play returns to the beginning 246 to receive the next wager and start the next hand. If all panels 316 have been illuminated, the player has won the bonus 314 and the amount shown in the bonus meter 314 is paid to the player 248 or credited to his or her account. In the depicted embodiment, the bonus meter 314 is set to zero, all memory locations 138 are reset to zero and all indicators in the display 316 are unilluminated or unhighlighted 252. In other embodiments, the bonus meter may be re-set to a non-zero value. Play then returns 254 to the beginning so that a player may begin anew to attempt to achieve a bonus prize 314 by playing a series of hands or games.

Figure 4:
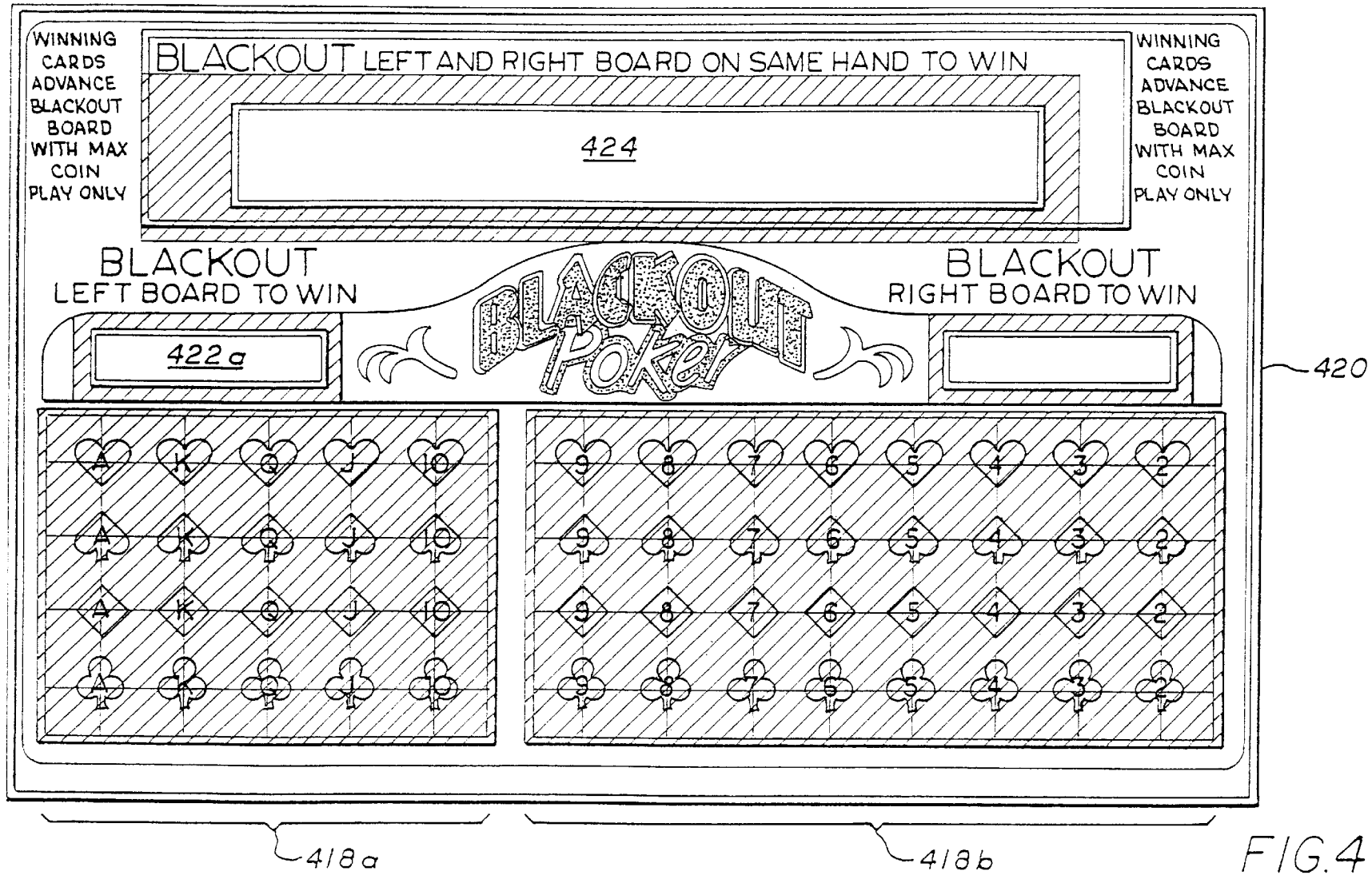
FIG. 4 is a front elevational view of a scoreboard device according to one embodiment of the present invention.

Although, in the above-described embodiment, the multi-game prize is won only when all of the memory locations 138 have reached a predetermined value, it is also possible to configure a device in which one or more subsets of the memory locations 138 are defined and in which a multi-game prize is won when all of the memory locations in any one of the subsets have reached a predetermined value. For example, in one embodiment, the device includes a scoreboard display such as that shown in FIG. 4. In the embodiment of FIG. 4, the scoreboard display 420 includes regions 418*a*, 418*b* containing indicia corresponding to fewer than all of the possible simulated cards in the game. Various subsets of all the cards in the game can be defined such as tens and all face cards 418*a*, nines through twos, all red cards, and the like. In the embodiment of FIG. 4, there are memory locations 138 corresponding to each of the indicia 418*a*, 418*b* in the defined subsets of all simulated cards in the game. When all of the memory locations 138 corresponding to the predefined subset 418*a* of all cards in the game has reached a predetermined value, a corresponding multi-game prize 422*a* is awarded. Preferably the display 420 provides indications 422*a*, 422*b* of the size or type of prizes associated with each subset 418*a*, 418*b* of indicia. In the depicted embodiment, the display 420 also provides an indication 424 of a prize associated with activating (e.g. unilluminating) all indicia in both subsets 418*a*, 418*b*, e.g. on the same hand.

If desired, prizes may be awarded in response to activating fewer than all indicia in a subset of the display, such as all indicia in one or more rows, columns or diagonals, four corners and the like. In such an embodiment, award of a prize based on activating, e.g., all indicia in a line may be followed by resetting (inactivating) the line indicia, or all indicia, or the player may be allowed to continue to play, without resetting any indicia, e.g., to attempt to activate all indicia in a subset.

If desired, the game may be configured such that the predetermined subset which is to be used as a basis for awarding a multi-game prize may change from time to time, e.g., depending on the amount wagered, the number of games played, the number of games won or lost, and the like. Thus, in such an embodiment, it is preferable to have memory locations 138 corresponding to all cards in the game and to also store in the memory of the computer an indication of which memory locations (and thus, of which cards in the game), are in the predetermined subset which must reach the predetermined minimum value for the multi-game prize to be awarded.

In light of the above description, a number of advantages of the present invention can be seen. The present invention provides a type of game-within-a-game feature for video poker players or other simulated card game players. The feature allows a player to build up to a bonus or payout that the player earns through playing multiple games. The feature tends to retain a player at a game for an extended period of time and is believed to enhance the entertainment value of the device and game as well as potentially increasing revenue. Since the player is able to see how far he or she is from earning the bonus, there is a constant incentive to continue playing. If the scoreboard is nearly full, it is believed a player is more likely to continue playing until he or she gets the bonus. Furthermore, it is believed that, for strategy-based games, a player, particularly a player who is close to earning a bonus, may use a riskier strategy in an attempt to fill the remainder of the bonus scoreboard, potentially earning additional revenue for the casino operator.

A number of variations and modifications of the invention can be used. Although a computer is depicted in one implementation of the invention, the invention can also be implemented using one or more application-specific integrated circuits (ASICs) or other hard-wired device, or using mechanical devices. Although the depicted embodiment provides the computer and/or software resident on each gaming machine, it is possible to provide some or all of the software or logic at a central location such as a network server for communication to a playing station such as over a local area network (LAN), wide area network (WAN), Internet connection, microwave link, infrared link, satellite link, and the like. Although a traditional video poker device such as that depicted in FIG. 3 can be used, it is also possible to use a general purpose device such as a desktop or laptop personal computer (PC) as a gaming device. The invention can be used in connection with card games other than simulated poker games, such as blackjack. The invention can be used in connection with non-card games, such as slot machines, by providing illuminatable, unilluminatable or otherwise activatable indicia corresponding to various slot machine (preferably winning) outcomes, such as three bars, three oranges, and the like.

In the depicted embodiment, progress toward the prize or bonus was achieved only in connection with necessary winning cards. However, the invention could also be implemented to provide for progress towards the prize based on non-necessary winning cards (e.g., all cards in a winning hand) or non-winning cards (such as all hands and all cards, or randomly selected hands or cards). It is also possible to provide for a combination of these schemes such as providing some incrementation of the memory location 138 in response to non-winning cards and a higher incrementation in response to winning cards. It is possible to provide for weighted incrementation of memory locations 138 such as providing more increments or points based on the type of win (e.g., greater incrementation for a royal flush) or the value of the cards (e.g., greater incrementation for a pair of kings than a pair of deuces). It is also possible to provide for non-integral (i.e., decimal) increments.

Although the depicted embodiment shows a configuration in which memory locations corresponding to all 52 cards must reach the minimum amount in order for the bonus to be won, it is possible to provide for winning a bonus when fewer than 52 of the counters have reached the minimum amount (either predetermined or randomly selected ones of the 52 cards or variable numbers, e.g., randomly selected or depending on the amount of initial wager or other input from the user). Although the depicted embodiment displays progress towards the goal by way of illuminating indicators corresponding to each of the 52 cards, other types of progress indicators can be provided such as a simulated slider, thermometer or gauge-like indicator, a percentage indicator, and the like. When illuminatable indicia are provided, various schemes can be provided for indicating which indicia have reached the predetermined minimum value, including illuminating the indicia, showing the indicia as a flashing display, changing color, and the like. In one "blackout" embodiment, all the relevant indicia are initially illuminated and an indicium is unilluminated when the corresponding memory location reaches its predetermined value, such that the multi-game prize is awarded when all relevant indicia have been unilluminated.

If desired, the games may be configured so that indicia which have been highlighted, or otherwise indicated, may be unhighlighted, e.g., at random time, after passage of a predetermined time or in response to predetermined or random events.

In the depicted embodiment, when the bonus meter and counter 136, 138 are reset, they are reset to a value of zero. It is also possible to provide for a configuration in which some or all of these memory locations are reset to non-zero (either positive or negative) values. Although the depicted embodiment shows a configuration in which the bonus meter 136 and memory locations 138 are reset when a bonus is won, it is possible to provide for a reset under other circumstances such as when a machine has been idle for a predetermined period of time, when a new player inserts a new player card, and the like.

In one embodiment, a player card may be configured to store a player's progress towards the bonus so that a player may interrupt a string of games, store his progress and, later, reinitiate the string of games by inserting the player card, whereupon the computer will reestablish the contents player's of the bonus meter 136 and memory locations 138 which the player formerly had upon ceasing play.

Although the invention has been described in the context of a configuration in which the bonus and bonus display are coupled to a single gaming device, it is also possible to couple the bonus display to two or more gaming devices so that two or more players may play towards a common multi-game prize which may, if desired, be a progressive prize, with an amount which increases as more wagers are placed. In one embodiment, two or more gaming devices are coupled over a network, such as a local area network (LAN) or wide area network (WAN), with all such coupled devices being able to increment common scoreboard counters or otherwise make progress towards a common multi-game goal. If desired, several layers of scoreboard games may be interleaved, such as by providing networked gaming devices which are configured such that triggering events result in progress toward either or both of a local multi-game goal (i.e., one whose counters or other goal-calculating devices are incremented or toggled only in response to events on a single gaming device) and a linked multi-game goal (i.e., one whose counters or other goal-calculating devices are incremented or toggled in response to events in any of a plurality of linked or networked gaming devices). In a fully interleaved system, a single gaming device can make progress toward both a local multi-game goal and a linked multi-game goal, with progress towards both goals preferably being displayed on a single bonus display or "scoreboard." When such multi-game prize is won, it can be distributed in a number of ways such as among all participating players or gaming devices, or only to the player who activated the last indicium needed for the prize. In one embodiment, a single bonus display is shared among a plurality of gaming devices, such as by all devices on a particular bank of gaming machines of a casino. In one embodiment, the occurrence of a winning hand or other trigger event on any of the plurality of gaming devices causes incrementation of a corresponding counter or otherwise contributes to progress toward the multi-game goal. This embodiment is believed to augment the entertainment value of gaming devices, e.g., by allowing friendly competition/cooperation among players or groups of players.

Although in the depicted embodiment the value for the bonus meter is progressive (increases with time, or dependent on the amount wagered), it is also possible to provide for a fixed bonus amount. In the depicted embodiment, the counters 138 were required to reach a minimum value of 5 for a corresponding position on the scoreboard to be illuminated. It is also possible to provide for a value different from 5, including 1, to provide for different values for different cards, or to provide for values which vary such as being selected randomly or dependent on wagers or other player input.

Although the invention has been defined by way of a preferred embodiment and certain variations and modifications, other variations and modifications can also be used, the invention being defined by the following claims:

What is claimed is:

1. Apparatus for playing series of games, each series having a plurality of games, comprising:

a computer configured to display indications of simulated gaming pieces;

an input device for receiving gaming input from a player and providing said input to said computer;

said computer configured to control a display to provide an indication, to said player, of progress towards a multi-game goal, wherein, in at least one of said series, reaching said multi-game goal requires playing at least two games in said at least one of said series, wherein said computer calculates, during or after at least some of said series of games, a credit total potentially available to said player, and wherein a multi-game prize based on said credits is awarded said player when said multi-game goal is reached;

said credit total and said indication of progress being reset to beginning credit and initial progress values, respectively, when said prize is awarded to said player.

2. Apparatus, as claimed in claim 1, wherein said series of games include simulated card games.

3. Apparatus, as claimed in claim 2, wherein said simulated card games comprise simulated poker games.

4. Apparatus, as claimed in claim 2, wherein said multi-game goal comprises accumulating indicators corresponding to at least some cards used in said series of simulated card games.

5. Apparatus, as claimed in claim 1, wherein said computer is configured to control a display to display an indication of said total credits.

6. Apparatus, as claimed in claim 1, further comprising an input device for receiving a wager from said player.

7. Apparatus, as claimed in claim 6, wherein said total credits are incremented an amount based on the amount of wagers received from said player.

8. Apparatus, as claimed in claim 1 wherein said beginning credit value is zero.

9. Apparatus as claimed in claim 1 further comprising a display controlled to provide an indication of the size of said multi-game prize, wherein said indication of the size of said multi-game prize different from said indication of progress towards said multi-game goal.

10. Apparatus for playing series of games, each series having a plurality of games, comprising:

display means for displaying, under control of a computer, indications of gaming pieces;

input means for receiving gaming input from said player and providing said input to said computer;

said computer configured to control a display to provide an indication, to said user, of progress towards a multi-game goal wherein, in at least one of said series, reaching said multi-game goal requires playing at least two games in said at least one of said series;

wherein, said computer calculates, during or after at least some of said series of games, a credit total potentially available to said player, and wherein a multi-game prize based on said credits is awarded said player when said multi-game goal is reached.

11. Apparatus, as claimed in claim 10, wherein said credit total and said indication of progress are reset to beginning credit and progress values, respectively, when said prize is awarded to said player.

12. A computer-implemented method for playing a series of games, comprising:

a) providing a computer coupled to a display, an input device and a wager-acceptor;

b) accepting at least a first wager from a player;

c) incrementing a credit total and displaying on indication of a multi-game prize based on said credit total;

d) playing one of said series of games;

e) displaying an indication of progress towards a multi-game goal, different from said indication of a multi-game prize;

f) repeating steps b) through c) and playing a second one of said series of games;

g) incrementing or decrementing said indication of progress in response to said second one of said series of games;

h) awarding said multi-game prize, based on said credit total, to said player when said multi-game goal is reached.

13. A computer implemented method as claimed in claim 12 wherein said step of incrementing a credit total comprises incrementing by a predetermined portion of said wager.

14. A computer implemented method as claimed in claim 12, when said games include simulated card games, and wherein said step of incrementing a credit total comprises incrementing by an amount based on the number of games played, the number of winning cards or the number of non-winning games.

15. A computer implemented method as claimed in claim 14, wherein said computer is configured to provide a plurality of counters corresponding to at least some cards used in said series of simulated card games and wherein said step of displaying an indication of progress comprises:

incrementing said counters corresponding to simulated cards received by the user during play of said simulated card game which were necessary to a winning hand;

providing a display which indicates at least those cards having a corresponding counter that has reached a predetermined minimum value.

16. A computer implemented method as claimed in claim 14 wherein said simulated card game comprises play of N simulated cards and wherein said computer is configured to provide N counters, each corresponding one of said simulated cards and wherein said step of displaying an indication of progress comprises providing N illuminatable regions, each providing an indication of a corresponding one of said N simulated cards, incrementing said counters corresponding to simulated cards received by the user during play of said simulated card game which were necessary to a winning hand;

illuminating at least those regions corresponding to a simulated card which has a corresponding counter that has reached a predetermined minimum value.

17. A method, as claimed in claim 16, wherein N is 52.

18. A computer implemented method as claimed in claim 12 wherein said computer is configured to provide a plurality of counters and wherein said step of awarding a multi-game prize comprises awarding an amount equal to said credit total when all of at least a predetermined subset of said plurality of counters has reached said predetermined minimum value.

19. A computer implemented method as claimed in claim 18 wherein a plurality of subsets of said plurality of counters are defined, and wherein said display includes a discrete region corresponding to each said subset of said plurality of counters.

20. A computer-implemented method, as claimed in claim 19, wherein said display indicates a prize amount associated with each subset of said plurality of counters.

21. A computer-implemented method, as claimed in claim 20, wherein said display further indicates a prize amount associated with said plurality of counters.

22. Networked gaming apparatus for playing a series of games, comprising:

at least first and second gaming terminals configured to display indications of simulated gaming pieces, said first and second gaming terminals each having an input device for receiving gaming input from first and second players, respectively, and providing said input to a computer;

said computer coupled to at least a first display to provide an indication of progress towards a common multi-game goal, wherein play on each of said first and second gaming terminals generates a plurality of events, and wherein at least a first sub-plurality of events generated by either said first gaming terminal or said second gaming terminal result in progress towards said common multi-game goal, wherein said computer calculates, during or after at least some of said series of games, a credit total potentially available to at least one of said first and second players, and wherein a linked prize based on said credits is awarded to at least one of said first and second players when said common multi-game goal is reached.

23. Networked gaming apparatus, as claimed in claim 22, wherein a second sub-plurality of events generated by said first gaming terminal results in progress towards a non-common multi-game goal and wherein a local prize is awarded to said first player when said non-common multi-game goal is reached.

24. Networked gaming apparatus, as claimed in claim 23, wherein said first display provides an indication of progress towards said non-common multi-game goal and provides an indication of said local prize.

25. A computer-implemented method for playing a series of simulated poker games which involves play of N simulated cards, comprising:

providing a computer coupled to a display, an input device and a wager-acceptor;

providing N counters, each corresponding one of said simulated cards accepting at least a first wager from a player;

incrementing a credit total by a predetermined portion of said wager;

playing one of said series of simulated poker games;

providing N regions, each providing an indication of a corresponding one of said N simulated cards and each being controllable to provide a first indication that the counter corresponding to the corresponding card has reached a predetermined minimum value, determining if said one of said series of simulated poker games resulted in a win for said player, and when there has been a win (a) incrementing said counters corresponding to simulated cards received by the user during play of said simulated card game which were necessary to said win;

(b) controlling at least those regions corresponding to a simulated card which has a corresponding counter that has reached a predetermined minimum value to provide said first indication; and (c) awarding a prize having an amount equal to said credit total when all of said N counters has reached said predetermined minimum value.

26. A method, as claimed in claim 25, wherein N is 52.

27. A method, as claimed in claim 25, wherein said first indication comprises illuminating said region.

28. A method, as claimed in claim 25, wherein said first indication comprises unilluminating said region.

* * * * *

UNITED STATES PATENT AND TRADEMARK OFFICE

CERTIFICATE OF CORRECTION

PATENT NO. : 5,851,148
DATED : December 22, 1998
INVENTOR(S) : Chris T. Brune et al.

It is certified that error appears in the above-identified patent and that said Letters Patent is hereby corrected as shown below:

Title page,
Item [56], add to References Cited,

| -- | U.S. PATENT DOCUMENTS | |
|---|---|---|
| 5,022,653* | 6/1991 | Suttle et al |
| 5,042,818* | 8/1991 | Weingardt |
| 5,275,400* | 1/1994 | Weingardt et al |
| 5,702,304* | 12/1997 | Acres et al |
| 5,707,287* | 1/1998 | McCrea, Jr. |

* cited by examiner --.

Signed and Sealed this

Eleventh Day of March, 2003

JAMES E. ROGAN
*Director of the United States Patent and Trademark Office*